US005865967A

United States Patent [19]

Hiai et al.

[11] Patent Number: 5,865,967

[45] Date of Patent: Feb. 2, 1999

[54] CATHODE PLATE USED FOR HYDRO-ELECTRO-WINNING OR ELECTRO-REFINING

[75] Inventors: Hiroshi Hiai; Akira Ikeda; Toshinori Ishii, all of Ibaraki, Japan

[73] Assignee: Nippon Mining & Metals Co., Ltd., Tokyo, Japan

[21] Appl. No.: 792,751

[22] Filed: Feb. 4, 1997

[30] Foreign Application Priority Data

Feb. 21, 1996 [JP] Japan ..... 8-033417

[51] Int. Cl.[6] ..... C25D 1/00

[52] U.S. Cl. ..... 204/281; 204/280; 204/288; 204/290 R

[58] Field of Search ..... 205/380, 384; 204/244, 245, 280, 281, 290 R, 288

[56] References Cited

U.S. PATENT DOCUMENTS 3,798,151 3/1974 Takamura et al. ..... 204/281
4,137,130 1/1979 Willans ..... 204/281
4,186,074 1/1980 Perry ..... 204/288

FOREIGN PATENT DOCUMENTS 59-13089 A 1/1984 Japan .
63-307292A 12/1988 Japan .
2-61086 A 3/1990 Japan .

*Primary Examiner*—Bruce F. Bell
*Attorney, Agent, or Firm*—Kubovcik & Kubovcik

[57] ABSTRACT

Metal is electrolytically precipitated on a cathode plate except for a portion thereof. The non-precipitated portion enables easy peeling of the precipitated metal from the cathode plate. The ceramic coating film is formed on the non-precipitated portion and prevents intrusion of electrolytic acid between the ceramic coating film and the cathode plate. The life of the coating is prolonged. The polishing of the cathode plate can be automatized.

10 Claims, 1 Drawing Sheet

CATHODE PLATE USED FOR HYDRO-ELECTRO-WINNING OR ELECTRO-REFINING

BACKGROUND OF INVENTION

1. Field of Invention

The present invention is related to hydro-electro-winning or electro-refining of metals, such as copper, zinc and nickel, particularly to a cathode plate which is a substrate for precipitating metals thereon in the form of a sheet during the hydro-electro-winning or electro-refining. The above-mentioned cathode plate and precipitated metal are referred to as the mother plate and the mold plate, respectively. The present invention is more particularly related to the mother plate having an improved insulating structure for shielding its edge portion from the electrolytic precipitation of metals.

2. Description of Related Art

The edge portion and side of a mother plate have been coated with an insulator so as to enable the mold plate to be peeled from the mother plate. Since the electrolyte liquid for obtaining the mold plate is based on sulfuric acid and is acidic, the insulator used as the coating of the mother plate's edge portion must be resistant to the sulfuric acid. The insulator must also be well bonded to the mother plate.

The conventional coating methods of the insulator are provided for example (a) bonding a vinyl-chloride sheet, (b) applying an insulating resin, (c) applying a heat-resistant resin such as epoxy resin via a vinyl-chloride sheet (Japanese Unexamined Patent Publication No. 50-160,121), (d) applying a polyurethane rubber (Japanese Unexamined Patent Publication No. 59-13,089), (e) applying a fluorine rubber (Japanese Unexamined Patent Publication No. 63-307,292), and (f) applying a resin which is mainly composed of dimethyl polysiloxane (Japanese Unexamined Patent Publication No. 2-61,086).

The method (a), in which a vinyl-chloride sheet is applied, incurs problems such as: the adhesion of the sheet decreases during the electrolyzing; the electrolyte liquid penetrates between the mother plate and the insulator; and, the metal inevitably precipitates in the clearance between the mother plate and the insulator during the electrolyzing. When the mold plate is peeled from the mother plate, the metal, which has been precipitated onto the edge of the mother plate, is incorporated is the vinyl chloride. Alternatively, the precipitated metal so grows to such an extent that the vinyl-chloride sheet ruptures. The method (a) is, therefore, disadvantageous in the point that the life of the insulator, i.e., the vinyl-chloride sheet, is very short.

The method (d) can eliminate these advantages since the dimethyl polysiloxane used has good flexibility and sealing property.

The method (c) eliminates the high-cost problem of the method (a). The method (d) emphasizes the excellent acid-resistance of polyurethane rubber and aims to improve the shielding performance of the insulator against the electrolytic precipitation.

In addition, in the conventional insulator-coating methods (c) through (f) the coating is provided on the mother plate at its peripheral or edge portions of the main surface.

The conventional coating materials, which are applied as the insulator of the peripheral or edge portions of the mother plate, are resin and rubber. These materials are usually referred to as the protector. The protector is applied by means of application with a brush or bonding with a binder. However, since the bonding property of the resin materials of the protector with the metal of the mother plate is poor, the insulator function is lost in a relatively limited number of times of the electrolysis process and hence must be replaced. In addition, the mother plate has to be polished after lapse of a certain period. Since the conventional material is applied on the peripheral or edge portions of the main surface of the mother plates, such material must be preliminarily removed when the polishing is carried out.

SUMMARY OF THE INVENTION

It is an object of the present invention to provide a cathode plate used for hydro-electro-winning or electro-refining, in which a mold plate is easily peeled from a mother plate without using a conventional protector.

In accordance with the objects of the present invention, there is provided a cathode plate used in hydro-electro-winning or electro-refining for electro-winned or electro-refined metal on a first surface, comprising:

a first surface, on which the electro-winned or electro-refined metal is precipitated;

a second surface, on which the electro-winned or electro-refined metal does not precipitate, thereby enabling peeling of the precipitated metal from the cathode plate; and, a ceramic coating film formed on the second surface.

As the ceramic insulator, one or more oxides such as $Al_2O_3$, $TiO_2$ and $Cr_2O_3$, as well as one or more nitrides such as AlN, TiN, and CrN can be preferably used, because these materials have excellent resistance against acid. Thickness of the ceramic coating film is preferably from 100 to 1000 $\mu$m.

The ceramic coating can be formed by means of physical vapor deposition (PVD), flame spraying and the like. In PVD, ion-plating or sputtering can be used to form the ceramic coating film as follows. Argon is impinged upon a metal target such an Al, Ti or Cr target, and these atoms are then reacted with oxygen to form a compound, which is laminated on the mother plate.

The flame-spraying method is the most preferred, because a thick coating can be formed in a short period of time. An atmospheric-pressure plasma-spraying method is preferred, in which Ar, He, $H_2$, $N_2$ or the like is activated to form a plasma gas, which is impinged on a substrate as plasma jet having temperature of 1000° C. or more. The ceramic powder to be sprayed is preferably of from 5 to 80 $\mu$m in grain size.

The ceramic coating film according to the present invention may be formed, as in the conventional method, on the mother plate at its peripheral portions of the main surface and side portions. However, since the ceramic coating film according to the present invention exhibits excellent adherence property with the mother plate, it may be formed only on a portion of the mother plate, defining its thickness (this portion is hereinafter referred to as "the thickness portion"). Furthermore, only a portion of the thickness portion to be immersed in the electrolyte liquid can be coated with the ceramic film, while the other portion, e.g., top of the thickness portion, not immersed in the electrolyte liquid needs not be coated. In an embodiment of the present invention to limit the coating only to the thickness portion, the bonding area between the coating and the mother plate is smaller than in the conventional method. However, since the ceramic coating film has improved adherence bonding property, the durability of the ceramic coating film in the electrolyte liquid is satisfactory.

DESCRIPTION OF PREFERRED EMBODIMENTS

Figure 1:
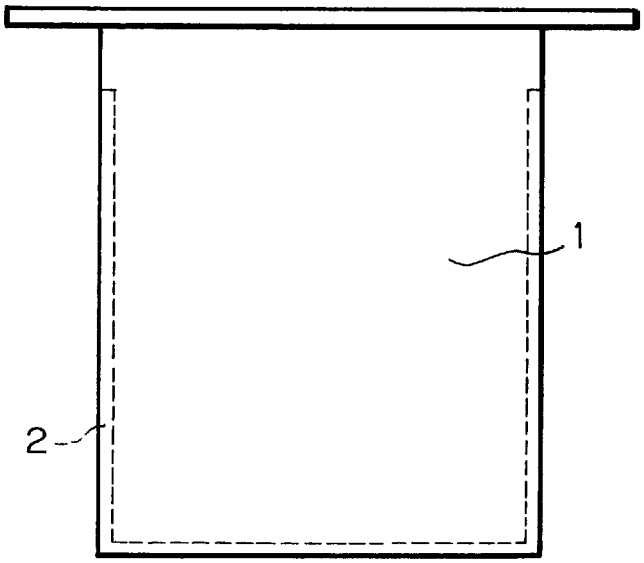
FIG. 1 is a plan view of a mother plate.
Figure 2:
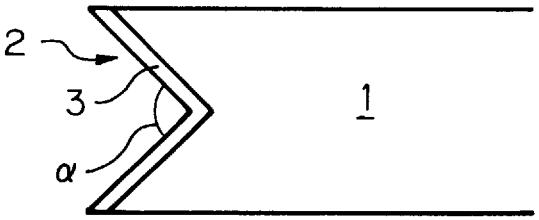
FIG. 2 is a cross-sectional view of a mother plate at its edge portion, applied with an insulator on thickness portion.

In FIG. 1 the thickness portion of a mother plate 1 is denoted by the reference numeral "2". The mother plate 1 is provided with a V-shaped groove at the thickness portion 2 only in its region being in contact with the electrolyte liquid. A flame-spraying gun (not shown) for spraying the ceramic powder is positioned above the mother plate 1 to be flame-sprayed so as to deposit the ceramic material on the V-shaped groove. This V-shaped groove can further enhance the adherence of the ceramic material. Preferably, the angle ($\alpha$, in FIG. 2) of the V-shaped groove is from 60° to 120°, the thickness of the V-shaped groove is from 2 to 10 mm.

When the flame-sprayed film solidifies, the air incorporated in such film may remain as the blow holes which amount to from 2 to 10% by volume, although the amount depends upon the flame-spraying condition. Since the sulfuric acid may penetrate into the blow holes or metal may deposit in the blow holes, the blow holes are preferably sealed. Measures for sealing the blow holes are to use a water-glass sealant or silicone-resin sealant.

The insulating property and corrosion resistance of the ceramics required for the electro-winning and electro-refining are at the same level as those of the resin or the like used for the electro-winning and electro-refining. Adherence of the ceramics on the metal is considerably superior to the adherence of the resin on the metal, particularly after immersion in the electrolyte liquid. When the resin coating film is repeatedly immersed in the electrolyte liquid for approximately a hundred times, the adherence is seriously deteriorated due to the effects of the electrolyte liquid.

Since the adherence property of ceramics-metal is excellent as described above, almost no clearance is formed between the ceramic coating film and the metal substrate. Precipitation of the electro-winned or electro-refined metal in the clearance, therefore, hardly occurs. However, if any pores are present on the upper surface of the ceramic coating film and extend up to the substrate surface, copper or the like precipitates on the coating. When the amount of so-precipitated copper or the like largely increases, a current-conducting pass from the coating surface to the substrate surface is formed, which means that the ceramic coating film is lost. The ceramic coating film is, therefore, preferably subjected to sealing of pores or the like.

When the ceramic coating film is applied only on the thickness portion, the insulating coating does not in any way impede the polishing of the main surface of the mother plate. This can, therefore, be easily polished.

The present invention is hereinafter described with reference to the examples.

EXAMPLE 1

A mother plate 1 (FIG. 1), 3 mm thick and approximately 1000 mm square in size was made of stainless steel (SUS 316 L). A V-shaped groove 2 with depth of 1.5 mm and angle of 90° was cut on the side surface of the edge, i.e., the thickness portion. $Al_2O_3$ (purity—99.7%) was flame-sprayed on the V-shaped groove 2 to a thickness of 300 $\mu$m so as to form a ceramic coating film. This ceramic coating film was subjected to sealing of pores. The pore-sealing treatment was carried out by applying silicone resin (Silicone Sealant SA-45 produced by Shinetsu Polymer Co., Ltd.) using a brush, and then left to stand room temperature for 24 hours to cure the resin. The cathode plate with an insulator coating was provided by the process as described above.

The cathode plate was immersed in the electrolyte liquid which had sulfuric-acid concentration of from 180 to 220 g/L, copper concentration of from 30 to 55 g/L, nickel concentration of from 10 to 15 g/L, As concentration of from 3 to 5 g/L, Sb concentration of from 0.3 to 0.5 g/L, Bi concentration of approximately 0.1 g/L. Either electro-winning or electro-refining of metal was carried out under the conditions of current density of from 200 to 350 A/dm$^2$, liquid temperature of 60° C. In the case of electro-winning an insoluble anode was used, while a crude-copper anode was used in the case of electro-refining. In each case, pure copper having purity of 99.99% was deposited on the main surface of the cathode plate.

After each hundred times of electro-winning and electro-refining followed by peeling of the electro-deposited copper plate, only polishing was needed to start the next hundred times of operation. The ceramic coating film did not require any repair until the approximately 300 times of electro-winning and electro-refining followed by peeling. Contrary to this, in the conventional method using a bonded vinyl chloride sheet, the protector must be replaced and the polishing must be carried out after a hundred times of electro-winning and electro-refining followed by peeling.

EXAMPLE 2

Instead of $Al_2O_3$ used in Example 1, $Cr_2O_3$ (purity—96%, impurities—2% of $TiO_2$ and 2% of others) was used and the ceramic coating was carried out as in Example 1. The electro-winning or electro-refining was carried out as in Example 1. The results obtained are the same as in Example 1.

As is apparent from the description hereinabove, the conventional protector is not used in the present invention. Since the ceramic coating film may not be formed on the peripheral surface of the mother-plate's main surface but may be formed only on the thickness portion, the polishing of the cathode plate can be automatized, and labor-power can be saved. The ceramic coating film has a longer life than the conventional protector.

We claim:

1. A cathode plate used in hydro-electro-winning or electro-refining for precipitating electro-winned or electro-refined metal, comprising:

a first surface, on which the electro-winned or electro-refined metal is precipitated;

a second surface which defines the thickness of the cathode plate and has a grooved cross section and on which the electro-winned or electro-refined metal does not precipitate, thereby enabling peeling of the precipitated metal from the cathode plate; and, a ceramic coating film formed on the second surface.

2. A cathode plate according to claim 1, wherein the ceramic coating film is formed on a portion of the cathode plate immersed in an electrolyte liquid.

3. A cathode plate according to claim 1, wherein the groove is V-shaped.

4. A cathode plate according to claim 1, wherein said ceramic coating film is formed by flame spraying.

5. A cathode plate according to claim 4, further comprising a sealant on the flame-sprayed ceramic coating film.

6. A cathode plate according to claim 1, wherein said ceramic is at least one selected from the group consisting of $Al_2O_3$, $TiO_2$, $Cr_2O_3$, AlN, TiN, and CrN.

7. A cathode plate according to claim 6, wherein said ceramic is at least one selected from the group consisting of $Al_2O_3$, $TiO_2$ and $Cr_2O_3$.

8. A cathode plate according to claim 7, wherein said ceramic coating film has a thickness of from 100 to 1000 $\mu$m.

9. A cathode plate according to claim 6, wherein said ceramic coating film is formed by plasma spraying.

10. A cathode plate coating according to claim 9, wherein said ceramic is at least one selected from the group consisting of $Al_2O_3$, $TiO_2$ and $Cr_2O_3$.

* * * * *